US005569333A

United States Patent [19]

Takahashi

[11] Patent Number: 5,569,333

[45] Date of Patent: Oct. 29, 1996

[54] PROCESS FOR PRODUCING A MATERIAL FOR A PERMANENT MAGNET

[75] Inventor: Yasunori Takahashi, Tokyo, Japan

[73] Assignees: Kawasaki Teitoku Co., Ltd.; Komeya, Inc.; Sanei Kasei Co., Ltd., all of Tokyo, Japan

[21] Appl. No.: 460,636

[22] Filed: Jun. 2, 1995

Related U.S. Application Data

[62] Division of Ser. No. 318,289, Oct. 5, 1994, Pat. No. 5,453,137.

[30] Foreign Application Priority Data

Mar. 30, 1994 [JP] Japan ..... 6-82668

[51] Int. Cl.[6] ..... H01F 1/03

[52] U.S. Cl. ..... 148/105; 427/127; 427/131

[58] Field of Search ..... 148/105; 427/127, 427/131

[56] References Cited

U.S. PATENT DOCUMENTS

| | | | |
|---|---|---|---|
| 4,082,905 | 4/1978 | Stephan et al. | 428/538 |
| 4,804,561 | 2/1989 | Tanioka et al. | 427/130 |
| 4,863,805 | 9/1989 | Suzuki et al. | 428/558 |
| 4,942,098 | 7/1990 | Hamamura et al. | 428/555 |
| 4,970,124 | 11/1990 | Oltean et al. | 428/403 |
| 5,225,281 | 7/1993 | Tamai et al. | 428/403 |

FOREIGN PATENT DOCUMENTS

| | | | |
|---|---|---|---|
| 0166597 | 1/1986 | European Pat. Off. | 148/301 |
| 61-34242 | 8/1986 | Japan . | |
| 63-67705 | 3/1988 | Japan . | |
| 372124 | 11/1991 | Japan . | |

OTHER PUBLICATIONS

Teitaro Hiraga et al., "Ferrite", Maruzen 1988, p. 45 (translation attached).

*Primary Examiner*—John Sheehan
*Attorney, Agent, or Firm*—Cushman Darby & Cushman, L.L.P.

[57] ABSTRACT

The material for permanent magnet according to the present invention comprises an acicular iron powder having successively on the surface (1) a coated layer of aluminum phosphate, (2) a diffused layer of rare earth element or a diffused layer of rare earth element.boron or a diffused layer of rare earth element.boron.nitrogen, and (3) a coated layer of aluminum phosphate.

The material for permanent magnet can be produced by (a) a step of mixing and covering an acicular goethite (FeOOH) crystal with aluminum phosphate, (b) a step of preparing an acicular iron powder coated with a layer of aluminum phosphate by reducing under hydrogen atmosphere at 300°–500° C. the acicular goethite (FeOOH) crystal covered by the aluminum phosphate, (c) a step of diffusing a rare earth element or a rare earth element and boron into the surface layer of aluminum phosphate by heating under argon atmosphere at 650°–1000° C. the acicular iron powder coated with a layer of aluminum phosphate in the presence of the rare earth element or the rare earth element and boron, (d) a step of mixing and covering the rare earth element diffused powder or rare earth element and boron diffused powder with aluminum phosphate, and (e) a step of coating the rare earth element diffused powder or rare earth element and boron diffused powder with aluminum phosphate by heating under argon atmosphere at 300°–500° C. the rare earth element diffused powder or rare earth element and boron diffused powder covered by the aluminum phosphate.

10 Claims, 3 Drawing Sheets

PROCESS FOR PRODUCING A MATERIAL FOR A PERMANENT MAGNET

This is a division of application Ser. No. 08/318,289, filed Oct. 5, 1994, now U.S. Pat. No. 5,453,137.

BACKGROUND OF THE INVENTION (1) Field of the Invention

The present invention relates to a permanent magnet, a production method of the same, and a material for the production, in which the permanent magnet includes a rare earth element.iron-permanent magnet, a rare earth element.iron.boron-permanent magnet and a rare earth element.iron.boron.nitrogen-permanent magnet superiordin magnetic characteristics.

(2) Description of the Prior Art

Rare earth element.iron.born-permanent magnets are highly praised for the superior magnetic properties. Japanese Patent B-61-34242 discloses a magnetically anisotropic sintered permanent magnet composed of Fe-B(2–28 atomic%)-R(rare earth element, 8–30 atomic%). For the production, an alloy containing the above-mentioned components is cast, the cast alloy is pulverized to an alloy powder, and the alloy powder is molded and sintered. However, the method has defects that the pulverization of cast alloy is a costly step, and the product performances fluctuate between production batches. Japanese Patent B-3-72124 discloses a production method of an alloy powder for a rare earth element.iron-.born-permanent magnet containing as the main component 8–30 atomic% of R (R is at least one rare earth element including Y), 2–28 atomic% of B and 65–82 atomic% of Fe. The method comprises steps of reducing the raw material powder containing the rare earth oxide, metal and/or alloy with metallic Ca or $CaH_2$ reducing agent, heating the reduced material in an inert atmosphere, and removing byproducts by leaching with water. Problems accompanied by the method are that steps for removing byproducts and drying are necessary due to the employment of metallic Ca or $CaH_2$ reducing agent, the obtained alloy powder is so fine as 1–10 μm that the powder is readily oxidized in air and the oxygen-containing powder brings about inferior magnetic properties in the final product, careful handling of the powder necessitates equipments/steps for measuring, mixing and molding thereof under air-insulated conditions, which cause increase in the production cost. Requirement of a large amount of rare earth element also increases the production cost.

SUMMARY OF THE INVENTION

It is an object of the present invention to provide a permanent magnet, a production method of the same, and a material for the production of the same, in which the permanent magnet includes a rare earth element.iron-permanent magnet, a rare earth element.iron.boron-permanent magnet and a rare earth element.iron.boron.nitrogen-permanent magnet obtainable easily and superior in magnetic characteristics.

The material for a permanent magnet according to the present invention comprises an acicular iron powder having successively on the surface (1) a coated layer of aluminum phosphate, (2) a diffused layer of rare earth element or a diffused layer of rare earth element.boron or a diffused layer of rare earth element.boron.nitrogen, and (3) a coated layer of aluminum phosphate.

DESCRIPTION OF THE PREFERRED EMBODIMENTS

Figure 1:
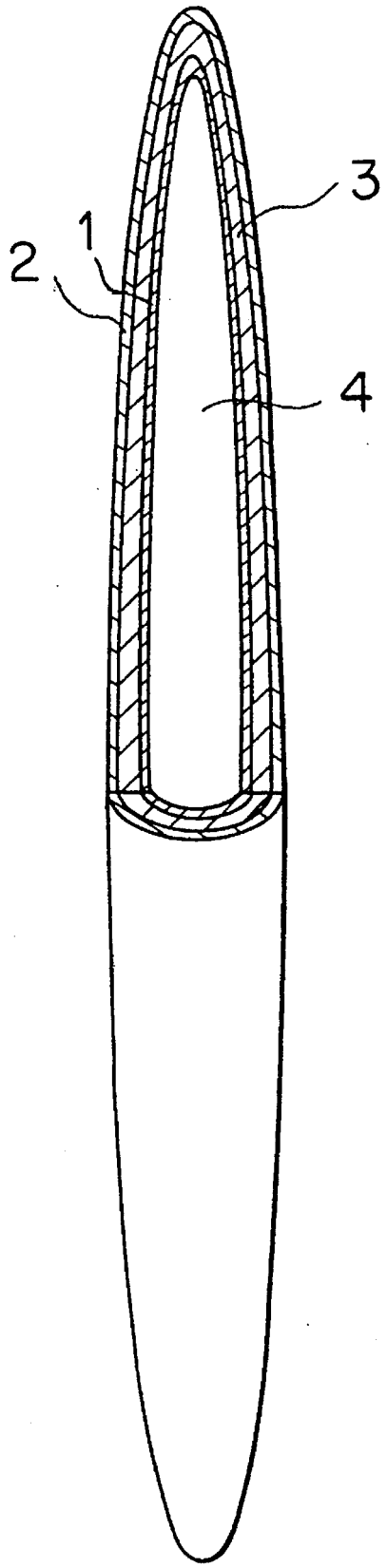
FIG. 1 shows a schematic model of the material for permanent magnet indicating acicular iron powder Fe having successively on the surface thereof a coating layer of aluminum phosphate X, a diffused layer of rare earth element Nd and boron B being Fe.Nd.B.X, and a coating layer of aluminum phosphate X.
Figure 2:
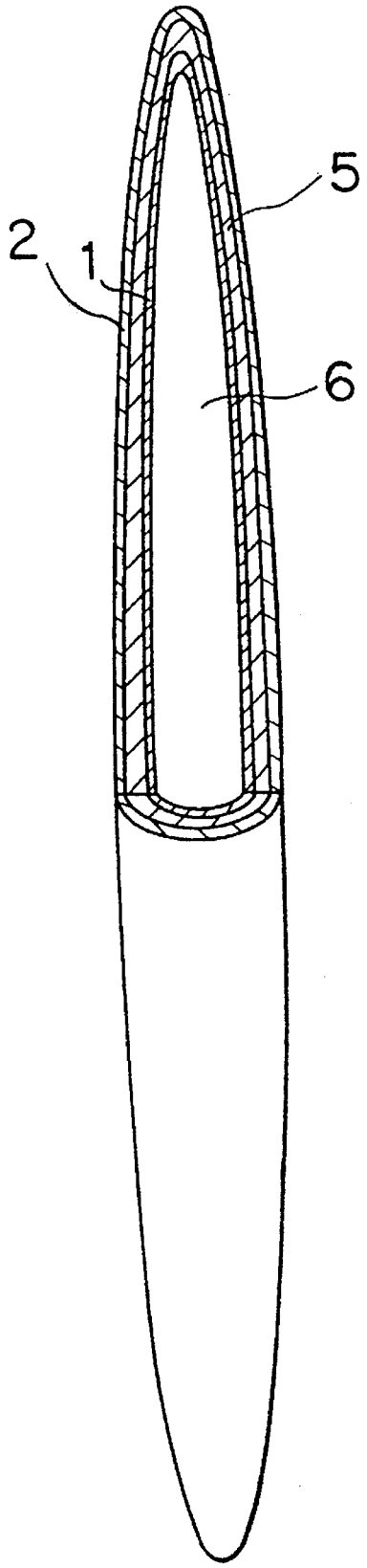
FIG. 2 shows a schematic model of the material for permanent magnet indicating acicular iron powder containing cobalt Fe.Co having successively on the surface thereof a coating layer of aluminum phosphate X, a diffused layer of rare earth element Sm and boron B being Fe.Co.Sm.B.X, and a coating layer of aluminum phosphate X.
Figure 3:
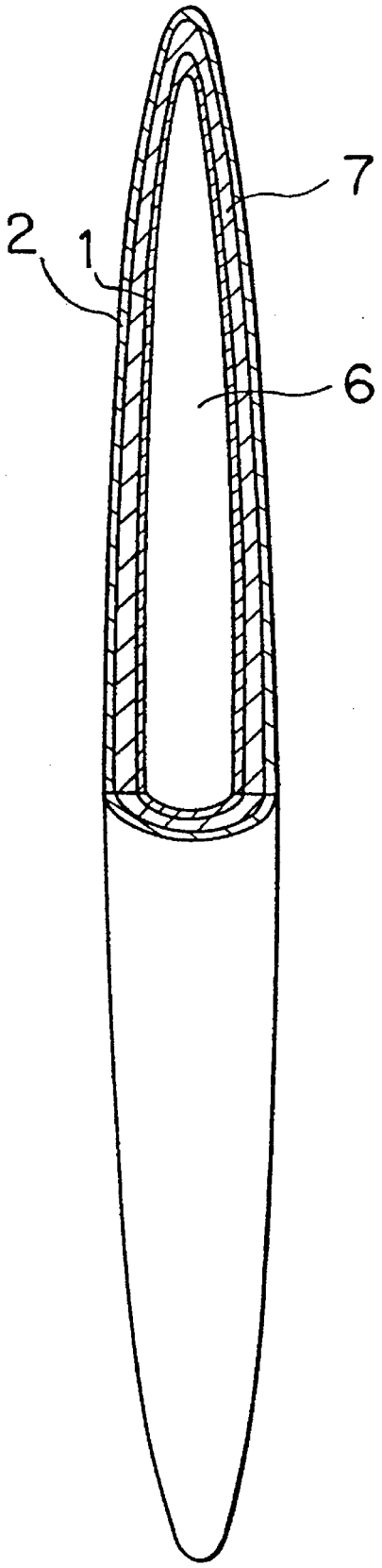
FIG. 3 shows a schematic model of the material for permanent magnet indicating acicular iron powder containing cobalt Fe.Co having successively on the surface thereof a coating layer of aluminum phosphate X, diffused layer of rare earth element Sm, boron B and nitrogen N being Fe.Co.Sm.B.N.X, and a coating layer of aluminum phosphate X.

Structural models of the material for the permanent magnet will be illustrated hereunder by use of the attached figures. FIG. 1 shows an acicular iron powder Fe, shown at 4 having successively on the surface (1) a coated layer of aluminum phosphate shown at 1, (2) a diffused layer of rare earth element Nd and boron B which is shown at 3, and (3) a coated layer of aluminum phosphate shown at 2. FIG. 2 shows an acicular iron powder containing cobalt Fe.Co shown at 6, having successively on the surface (1) a coated layer of aluminum phosphate shown at 1, (2) a diffused layer of rare earth element Sm and boron B, which is shown at 5, and (3) a coated layer of aluminum phosphate shown at 2. FIG. 3 shows an acicular iron powder containing cobalt Fe.Co shown at 6, having successively on the surface (1) a coated layer of aluminum phosphate shown at 1, (2) a diffused layer of rare earth element Sm, boron B and nitrogen N which is shown at 7, and (3) a coated layer of aluminum phosphate shown at 2.

As for the rare earth element, such rare earth elements generally used for rare earth element.iron.boron-permanent magnets as Nd, Pr, Dy, Ho, Tb, La, Ce, Pm, Sm, Eu, Gd, Er, Tm, Yb, Lu and Y are included, and one or more than two kinds thereof are employed. Among them, neodymium (Nd), praseodymium (Pr) and samarium (Sm) are used preferably. The rare earth element can be employed as alone, mixture or alloy with iron, cobalt, etc. Boron is employed not only as pure boron but also as ferroboron or impure boron containing Al, Si, C, etc.

The ratios of component are 1–12 mol%, preferably 1–10 mol%, for aluminum phosphate molecule; 0.5–20 mol%, preferably 0.5–7 mol%, for rare earth element atom; 0–12 mol% for boron atom, 0–10 mol% for nitrogen molecule; and the rest for iron. The component ratio enables the present magnet to have superior magnetic characteristics in spite of leaner contents of expensive rare earth elements in comparison with conventional rare earth element.iron.boron-permanent magnet.

As for a process of producing a material for permanent magnet in which an acicular iron powder has successively on the surface (1) a coated layer of aluminum phosphate, (2) a diffused layer of rare earth element or a diffused layer of rare earth element.boron, and (3) a coated layer of aluminum phosphate, the process comprises:

(a) a step of mixing and covering an acicular goethite (FeOOH) crystal with aluminum phosphate, (b) a step of preparing an acicular iron powder coated with a layer of aluminum phosphate by reducing under hydrogen atmosphere at 300°–500° C. the acicular goethite (FeOOH) crystal covered by aluminum phosphate, (c) a step of diffusing a rare earth element or a rare earth element and boron into the surface layer of aluminum phosphate by heating under argon atmosphere at 650°–1000° C. the acicular iron powder coated with the layer of aluminum phosphate in the presence of the rare earth element or the rare earth element and boron, (d) a step of mixing and covering the rare earth element diffused powder or rare earth element and boron diffused powder with aluminum phosphate, and (e) a step of coating the rare earth element diffused powder or rare earth element and boron diffused powder with aluminum phosphate by heating under argon atmosphere at 300°–500° C. the rare earth element diffused powder or rare earth element and boron diffused powder covered by aluminum phosphate.

As for a process of producing a material for permanent magnet in which an acicular iron powder has successively on the surface (1) a coated layer of aluminum phosphate, (2) a diffused layer of rare earth element.nitrogen or a diffused layer of rare earth element.boron.nitrogen, and (3) a coated layer of aluminum phosphate, the process comprises:

(a) a step of mixing and covering an acicular goethite (FeOOH) crystal with aluminum phosphate, (b) a step of preparing an acicular iron powder coated with a layer of aluminum phosphate by reducing under hydrogen atmosphere at 300°–500° C. the acicular goethite (FeOOH) crystal mixed with and covered by aluminum phosphate, (c) a step of diffusing a rare earth element or a rare earth element and boron into the surface layer of aluminum phosphate by heating under argon atmosphere at 650°–1000° C. the acicular iron powder coated with the layer of aluminum phosphate in the presence of the rare earth element or the rare earth element and boron, (d) a step of diffusing nitrogen into the rare earth element diffused surface layer or the rare earth element and boron diffused surface layer by heating under nitrogen atmosphere at 500°–300° C. the rare earth element diffused powder or the rare earth element and boron diffused powder, and (e) a step of mixing and covering the rare earth element and nitrogen diffused powder or rare earth element, boron and nitrogen diffused powder with aluminum phosphate, and (f) a step of coating the rare earth element and nitrogen diffused powder or rare earth element, boron and nitrogen diffused powder with aluminum phosphate by heating under argon atmosphere at 300°–500° C. the rare earth element and nitrogen diffused powder or rare earth element, boron and nitrogen diffused powder covered by aluminum phosphate.

The size of acicular iron powder is preferably not larger than 10 μm in particle size, for example, around 1.0 μm in length and 0.1 μm in width. The acicular iron powder coated with a layer of aluminum phosphate is obtained by a step of mixing and covering an acicular goethite (FeOOH) crystal having a particle size corresponding to that of the desired acicular iron powder with an aluminum phosphate, and a step of preparing an acicular iron powder coated with a layer of aluminum phosphate by reducing under hydrogen atmosphere at 300°–500° C. the acicular goethite (FeOOH) crystal covered by the aluminum phosphate.

Aluminum phosphate of commercially available powder form may be used for mixing and covering of acicular FeOOH, however, a uniform and compact covering is obtained easily when, for example, a 10% ethanol solution of aluminum phosphate is applied to acicular FeOOH. The amount of aluminum phosphate coated on the acicular iron powder (inner coated layer) is preferably around one half of the total amount of aluminum phosphate. For example, when 10 mol% of aluminum phosphate is used, preferably though not limited, 5 mol% thereof is used for the coated layer on the acicular iron powder (inner coated layer) and the remaining 5 mol% is for the coated layer on the outermost surface (outer coated layer). For the permanent magnet, aluminum phosphate contained therein never affects unfavorably but improves magnetic characteristics due to such functions as an oxidation inhibitor and a magnetic wall. For an acicular iron powder containing cobalt, cobalt powder or cobaltiron powder is mixed beforehand with acicular FeOOH.

By heating under argon atmosphere at 650°–1000° C. the aluminum phosphate coated acicular iron powder in the presence of a rare earth element or a rare earth element and boron, the rare earth element or the rare earth element and boron diffuses into the surface layer of aluminum phosphate coated acicular iron powder to form a Fe.R.(B).X layer as shown by 3 in FIG. 1, in which R denotes rare earth element(s) and X denotes aluminum phosphate. When an acicular iron powder containing cobalt is used, a Fe.Co.R.(B).X layer as shown by 5 in FIG. 2 is formed. The material for permanent magnet is obtained by further subjecting to a step of mixing and covering the above-mentioned rare earth element diffused powder or rare earth element and boron diffused powder with aluminum phosphate, and a step of coating the rare earth element diffused powder or rare earth element and boron diffused powder with aluminum phosphate by heating under argon atmosphere at 300°–500° C. the rare earth element diffused powder or rare earth element and boron diffused powder covered by aluminum phosphate, in which the obtained material has successively on the surface of acicular iron powder a coated layer of aluminum phosphate, a diffused layer of rare earth element or rare earth element.boron, and a coated layer of aluminum phosphate.

Heating the aluminum phosphate coated acicular iron powder in the presence of a rare earth element or a rare earth element and boron means heating the aluminum phosphate coated acicular iron powder either in a form of its mixture with pulverized rare earth element or rare earth element and boron, or under its contact with vapor of rare earth element or rare earth element and boron. The vapor of rare earth element or rare earth element and boron is obtainable by heating such lowmelting point and low boiling point alloys containing the desired components as rare earth element-iron alloys, rare earth element-cobalt alloys, rare earth element-boron alloys and ferroborons. When the rare earth element and boron are mixed in a form of powder, they are preferably pulverized in an average particle size of 1–10 μm for their better diffusion. In case of making the rare earth element or rare earth element and boron come in contact in vapor phase, powder of the lowmelting point and low boilingpoint alloys containing desired components is charged in a rotary furnace in which is placed a stainless tube with numerous pinholes containing the aluminum phosphate coated acicular iron powder, and the furnace is heated and rotated under argon atmosphere. Under the conditions, the component of alloy vaporizes and the vapor passes through pinholes of the stainless tube to deposit and diffuse into the surface layer of aluminum phosphate coated acicular iron powder. The rare earth element and boron deposit uniformly under vapor phase contact to result in products superior in the reproductiveness and quality. When the rare earth element and boron powder are mixed with the aluminum phosphate coated acicular iron powder, unevenness in the diffused amount and composition on the surface layer of aluminum phosphate coated acicular iron powder tends to occur mainly because of uneven mixing, though it depends on the particle sizes and mixing ratios. In each case, the heating is carried out in a closed atmosphere without flowing of argon gas.

As for the process for producing a material for permanent magnet having further a diffused layer of nitrogen, the process comprises a step of diffusing a rare earth element or a rare earth element and boron into the surface layer of aluminum phosphate by heating under argon atmosphere at 650°–1000° C. the acicular iron powder coated with a layer of aluminum phosphate in the presence of the rare earth element or the rare earth element and boron, and a step of heating under nitrogen atmosphere at 500°–300° C. by lowering the temperature and converting the atmospheric gas into nitrogen. The heating is conducted under flowing of nitrogen gas. A larger amount of diffused nitrogen is obtainable in accordance with higher temperatures and longer duration of gas flow, and the gas flow may be carried out at an arbitrary temperature within 500°–300° C. or during cooling from 500° C. to 300° C. Thus, the diffusion of nitrogen on the surface layer of aluminum phosphate coated acicular iron powder is completed, and is formed a Fe.Co.R.(B).N.X layer as shown by 7 in FIG. 3, in which R denotes rare earth element and X denotes aluminum phosphate. After completion of the nitrogen diffusion, the surface is covered by aluminum phosphate and then subjected to heating under argon atmosphere at 300°–500° C., by which is obtained the material for permanent magnet having successively on the surface of acicular iron powder or cobalt-containing acicular iron powder a coating layer of aluminum phosphate, a diffused layer of rare earth element.nitrogen or rare earth element.boron.nitrogen, and a coated layer of aluminum phosphate.

A material for permanent magnets having structures of the present invention is composed of a soft layer of the central acicular iron powder and a hard layer of rare earth element diffused layer, rare earth element.boron diffused layer or rare earth element.boron.nitrogen diffused layer, and permanent magnets prepared by sintering or bonding of the material can exhibit characteristics as exchanging spring permanent magnets.

From the material for permanent magnet having successively on the surface of an acicular iron powder a coated layer of aluminum phosphate, a diffused layer of rare earth element, rare earth element.boron or rare earth element.boron.nitrogen and a coated layer of aluminum phosphate is obtainable a sintered permanent magnet by subjecting the material to compression molding and sintering of the resulting compact in the presence of a magnetic field, in which the acicular iron powder is oriented vertically under the influence of the magnetic field. Conditions for the compression molding and sintering are the same as those for conventional sintered permanent magnet.

Magnetically anisotropic permanent magnet are obtainable by mixing the above material for permanent magnet with a binder and subjecting the mixture to hot compression molding in the presence of a magnetic field. The presence of magnetic field causes the acicular powder orient vertically. Conditions for the hot compression molding are the same as those for conventional bond permanent magnet. The binder includes polymeric materials like epoxy resins, polyamide resins, vitrification agents like MnO, CuO, $Bi_2O_3$, PbO, $Tl_2O_3$, $Sb_2O_3$, $Fe_2O_3$, and the combination thereof.

The present invention will be illustrated hereunder by reference to Examples, however, the invention never be restricted by the following Examples.

EXAMPLES 1–9

To acicular FeOOH (goethite; TITAN KOGYO K.K.) was added one half of a 10% ethanol solution containing mol% amount of aluminum phosphate relative to mol% amount of Fe as mentioned in Table 1, and the resulted material was mixed and dried. The dried material was subjected to reduction for 1 hour in a rotary kiln under ventilation of 10 liter/min of 100 vol% hydrogen gas and at 450° C. (raising or cooling rate was 5° C./min) to obtain an aluminum phosphate coated acicular iron powder of 0.9 μm length and 0.09 μm width. To the aluminum phosphate coated acicular iron powder were added pulverized rare earth element and boron of mol% mentioned in Table 1, and the material was mixed. The mixture was kept rotating in a rotary kiln at 800° C. (raising or cooling rate was 10° C./min) for 4 hours under atmosphere but no ventilation of argon to cause diffusion of the rare earth element and boron into the surface layer of aluminum phosphate coated acicular iron powder. To thus treated iron powder was added the remaining 10% ethanol solution of aluminum phosphate, and the material was mixed and dried. The dried material was kept in a rotary kiln at 450° C. (raising or cooling rate was 5° C./min) for 1 hour under an atmosphere of argon to form outer layer of aluminum phosphate on the powder, and obtained the material for permanent magnet.

The above-mentioned material for permanent magnet was subjected to measuring of the magnetization $4\pi I_{16K}$ (room temperature) at 16 KOe and Curie temperature Tc at 10 KOe by use of a vibration seismogram magnetometer (VSM), and the result is shown in Table 1. The material is recognized as being useful for permanent high flux magnets based on the $4\pi I_{16K}$ values of above 9 KG with no concern in kinds of rare earth elements, and the Tc of above 300° C. for most rare earth elements except for Ce (260° C.).

TABLE 1

| | Composition (mol %) | | | $4\pi I_{16k}$ (KG) | Tc (°C.) |
|---|---|---|---|---|---|
| Example 1 | 84Fe | 10X | 1B 5La | 15.2 | 380 |
| Example 2 | 84Fe | 10X | 1B 5Ce | 10.8 | 260 |
| Example 3 | 84Fe | 10X | 1B 5Pr | 11.2 | 340 |
| Example 4 | 84Fe | 10X | 1B 5Sm | 13.6 | 400 |
| Example 5 | 84Fe | 10X | 1B 5Gd | 10.9 | 370 |
| Example 6 | 84Fe | 10X | 1B 5Tb | 9.0 | 410 |
| Example 7 | 84Fe | 10X | 1B 5Nd | 9.2 | 350 |
| Example 8 | 79Fe | 10X | 1B 10Nd | 9.8 | 310 |
| Example 9 | 84Fe | 10X | 1B 2.5Nd + 2.5Tb | 9.0 | 370 |

EXAMPLES 10–24 AND COMPARATIVE EXAMPLES 1,2

To acicular FeOOH of the same as used for Examples 1–9 was added one half of a 10% ethanol solution containing mol% amount of aluminum phosphate relative to mol% amount of Fe as mentioned in Table 2, and the resulted material was mixed and dried. The dried material was subjected to reduction for 1 hour in a rotary kiln under ventilation of 10 liter/min of 100 vol% hydrogen gas and at 450° C. (raising or cooling rate was 5° C./min) to obtain an aluminum phosphate coated acicular iron powder of 0.9 μm length and 0.09 μm width. To the aluminum phosphate coated acicular iron powder were added pulverized rare earth element or rare earth element and boron of mol% mentioned in Table 2, and the material was mixed. The mixture was kept rotating in a rotary kiln at 800° C. (raising or cooling rate was 10° C./min) for 4 hours under atmosphere but no ventilation of argon to cause diffusion of the rare earth element and boron into the surface layer of aluminum phosphate coated acicular iron powder. To thus treated iron powder was added the remaining 10% ethanol solution of aluminum phosphate, and the material was mixed and dried. The dried material was kept in a rotary kiln at 450° C. (raising or cooling rate was 5° C./min) for 1 hour under an atmosphere of argon to form outer layer of aluminum phosphate on the powder, and obtained the material for permanent magnet of the present invention. For Comparative Example 1, acicular FeOOH alone without addition of aluminum phosphate was reduced to obtain acicular iron powder followed by diffusion of rare earth element alone on the surface under the same conditions, and the coating of aluminum phosphate thereon was omitted.

The above-mentioned material for permanent magnet was subjected to orientation-molding (under 10 KOe magnetic field and 1.5t/cm$^2$ pressure) and sintering under argon atmosphere at 1000°–1200° C. for 1 hour to obtain a permanent magnet.

The resulted permanent magnet was subjected to measuring the coercive force iHc, residual magnetic flux density Br and maximum energy product $(BH)_{max}$, and the result is shown in Table 2. All the Examples exhibit iHc of above 3 KOe necessitative for permanent magnet and superior features as Br of above 6 KG and $(BH)_{max}$ of above 10 MGOe.

TABLE 2

| | Composition (mol %) | | | | iHc (KOe) | Br (KG) | $(BH)_{max}$ (MGOe) |
|---|---|---|---|---|---|---|---|
| Comp. Ex. 1 | 95Fe | | | 5Nd | 4.08 | 1.08 | 1.20 |
| Example 10 | 94Fe | 1X | | 5Nd | 5.0 | 6.2 | 10.2 |
| Example 11 | 92Fe | 3X | | 5Nd | 5.2 | 8.0 | 13.1 |
| Example 12 | 90Fe | 5X | | 5Nd | 6.2 | 10.3 | 28.5 |
| Example 13 | 85Fe | 10X | | 5Nd | 8.9 | 12.4 | 39.0 |
| Example 14 | 84Fe | 10X | 1B | 5Nd | 9.4 | 13.8 | 41.6 |
| Example 15 | 75Fe | 10X | 10B | 5Nd | 10.4 | 11.0 | 38.4 |
| Example 16 | 88Fe | 10X | 1B | 1Nd | 17.0 | 12.8 | 55.0 |
| Example 17 | 79Fe | 10X | 1B | 10Nd | 8.8 | 12.6 | 35.8 |
| Example 18 | 74Fe | 10X | 1B | 15Nd | 5.5 | 10.7 | 20.4 |
| Example 19 | 69Fe | 10X | 1B | 20Nd | 4.6 | 7.6 | 12.6 |
| Example 20 | 79Fe | 10X | 1B | 10Pr | 7.4 | 11.5 | 32.8 |
| Example 21 | 74Fe | 10X | 1B | 15Pr | 5.0 | 9.8 | 20.0 |
| Example 22 | 69Fe | 10X | 1B | 20Pr | 3.8 | 8.0 | 15.4 |
| Example 23 | 84Fe | 6X | 5B | 5Nd | 16.3 | 9.6 | 45.6 |
| Example 24 | 86Fe | 6X | 3B | 5Nd | 15.1 | 12.3 | 49.2 |
| Comp. Ex. 2 | 64Fe | 10X | 1B | 25Nd | 5.0 | 3.5 | <1 |

The effect of aluminum phosphate (X) coating will be reviewed based on Examples and Comparative Example shown in Table 2A. It is noticed that superior magnetic characteristics are obtained without the existence of boron in contrast to the conventional knowledge. In systems having 5 mol% of diffused Nd, as small as 1 mol% of coated aluminum phosphate layer (0.5 mol% for inner layer and 0.5 mol% for outer layer) causes to increase remarkably Br and $(BH)_{max}$, and the tendency continues according to increased amounts of aluminum phosphate to reach at iHc of 8.9 KOe, Br of 12.4 KG and $(BH)_{max}$ of 39 MGOe when aluminum phosphate is 10 mol%. It is reasoned that the superior magnetic features will be noticeable even when the amount of aluminum phosphate becomes 12 mol% or more.

TABLE 2A (Abstract of Table 2)

| | Composition (mol %) | | | iHc (KOe) | Br (KG) | $(BH)_{max}$ (MGOe) |
|---|---|---|---|---|---|---|
| Comp. Ex. 1 | 95Fe | | 5Nd | 4.08 | 1.08 | 1.20 |
| Example 10 | 94Fe | 1X | 5Nd | 5.0 | 6.2 | 10.2 |
| Example 11 | 92Fe | 3X | 5Nd | 5.2 | 8.0 | 13.1 |
| Example 12 | 90Fe | 5X | 5Nd | 6.2 | 10.3 | 28.5 |
| Example 13 | 85Fe | 10X | 5Nd | 8.9 | 12.4 | 39.0 |

The effect of amount of diffused boron will be reviewed based on Examples shown in Table 2B. In systems having 10 mol% of aluminum phosphate (X) (5 mol% for inner layer and 5 mol% for outer layer) and 5 mol% of diffused rare earth element Nd, 1–10 mol% of diffused boron B exhibits no specific effect. It is reasoned that the tendency will be noticeable even when the amount of boron becomes 12 mol% or more.

TABLE 2B (Abstract of Table 2)

| | Composition (mol %) | | | | iHc (KOe) | Br (KG) | $(BH)_{max}$ (MGOe) |
|---|---|---|---|---|---|---|---|
| Example 13 | 85Fe | 10X | | 5Nd | 8.9 | 12.4 | 39.0 |
| Example 14 | 84Fe | 10X | 1B | 5Nd | 9.4 | 13.8 | 41.6 |
| Example 15 | 75Fe | 10X | 10B | 5Nd | 10.4 | 11.0 | 38.4 |

Notwithstanding the above, in systems having less than 10 mol%, 6 mol% for example, of aluminum phosphate (X) or less than 5 mol%, 1 mol% for example, of diffused Nd, the existence of an appropriate amount of boron results enhanced values in iHc, Br and $(BH)_{max}$ as shown in Example 16 by such high values as iHc of 17.0 KOe, Br of 12.8 KG and $(BH)_{max}$ of 55.0 MGOe.

TABLE 2C (Abstract of Table 2)

| | Composition (mol %) | | | | iHc (KOe) | Br (KG) | $(BH)_{max}$ (MGOe) |
|---|---|---|---|---|---|---|---|
| Example 12 | 90Fe | 5X | | 5Nd | 6.2 | 10.3 | 28.5 |
| Example 23 | 84Fe | 6X | 5B | 5Nd | 16.3 | 9.6 | 45.6 |
| Example 24 | 86Fe | 6X | 3B | 5Nd | 15.1 | 12.3 | 49.2 |
| Example 13 | 85Fe | 10X | | 5Nd | 8.9 | 12.4 | 39.0 |
| Example 16 | 88Fe | 10X | 1B | 1Nd | 17.0 | 12.8 | 55.0 |

The effect of the amount of diffused rare earth element will be reviewed based on Examples and Comparative Examples shown in Table 2. In systems having 10 mol% of aluminum phosphate (X) (5 mol% for inner layer and 5 mol% for outer layer) and 1 mol% of diffused boron, better magnetic characteristics are seen for less content of rare earth element Nd. However, the system of Comparative Example 2 containing 25 mol% of Nd is unusable as the $(BH)_{max}$ is below 1 MGOe. Since even a smaller content of rare earth element can exhibit superior effects, the small amount of rare earth element for the present magnets is economically preferable in comparison with conventional rare earth element.boron.iron-permanent magnet prepared by the alloy method.

TABLE 2D

| | (Abstract of Table 2) | | | | | | |
|---|---|---|---|---|---|---|---|
| | Composition (mol %) | | | | iHc (KOe) | Br (KG) | $(BH)_{max}$ (MGOe) |
| Example 16 | 88Fe | 10X | 1B | 1Nd | 17.0 | 12.8 | 55.0 |
| Example 14 | 84Fe | 10X | 1B | 5Nd | 9.4 | 13.8 | 41.6 |
| Example 17 | 79Fe | 10X | 1B | 10Nd | 8.8 | 12.6 | 35.8 |
| Example 18 | 74Fe | 10X | 1B | 15Nd | 5.5 | 10.7 | 20.4 |
| Example 19 | 69Fe | 10X | 1B | 20Nd | 4.6 | 7.6 | 12.6 |
| Comp. Ex. 2 | 64Fe | 10X | 1B | 25Nd | 5.0 | 3.5 | <1 |

Since rare earth element Pr shows about the same result as that of Nd, it is reasoned from the comparative data and results shown in Table 1 that various kinds of rare earth elements or mixtures thereof can be utilized for the present invention.

TABLE 2E

| | (Abstract of Table 2) | | | | | | |
|---|---|---|---|---|---|---|---|
| | Composition (mol %) | | | | iHc (KOe) | Br (KG) | $(BH)_{max}$ (MGOe) |
| Example 20 | 79Fe | 10X | 1B | 10Pr | 7.4 | 11.5 | 32.8 |
| Example 17 | 79Fe | 10X | 1B | 10Nd | 8.8 | 12.6 | 35.8 |
| Example 21 | 74Fe | 10X | 1B | 15Pr | 5.0 | 9.8 | 20.0 |
| Example 18 | 74Fe | 10X | 1B | 15Nd | 5.5 | 10.7 | 20.4 |
| Example 22 | 69Fe | 10X | 1B | 20Pr | 3.8 | 8.0 | 15.4 |
| Example 19 | 69Fe | 10X | 1B | 20Nd | 4.6 | 7.6 | 12.6 |

EXAMPLES 25–27

The material for permanent magnet was prepared by use of the amount of raw materials mentioned in Table 3, in which were included aluminum phosphate coated acicular iron powder having diffused rare earth element of Sm (Co—Sm alloy powder containing 40 weight% Sm was used) together with boron as Example 25, the acicular iron powder containing Co as Example 26 (the structure is shown in FIG. 2), and the diffused nitrogen as Example 27 (the structure is shown in FIG. 3). Table 4 indicates the composition expressed in terms of mol% converted from that of Table 3 expressed in weight parts. The diffusion of Sm and boron was conducted with the afore-mentioned vapor diffusion method at 880°–900° C. under argon atmosphere, which was followed by the diffusion of nitrogen by introducing nitrogen gas when the temperature was lowered (10° C./min) to 500° C. The coating of aluminum phosphate was done similarly to Examples 10–24. Sintered permanent magnet were prepared with thus obtained materials in the same manner as for Examples 10–24, and measurement of the coercive force iHc, residual magnetic flux density Br and maximum energy product $(BH)_{max}$ was conducted to have the result shown in Table 5. The employment of acicular iron powder containing Co (Example 26) or diffusion of nitrogen affects little on iHc, but results in enhanced values of Br and $(BH)_{max}$.

TABLE 3

| | Component (weight parts) | | | | | | | |
|---|---|---|---|---|---|---|---|---|
| | Acicular iron powder | | Inner coating | Diffused layer | | | | Outer layer |
| | Fe | Co | X | Sm | Co | B | $N_2$ | X |
| Example 25 | 95 | — | 5 | 2 | 3 | 1 | — | 5 |
| Example 26 | 85 | 10 | 5 | 2 | 3 | 1 | — | 5 |
| Example 27 | 85 | 10 | 5 | 2 | 3 | 1 | 5 | 5 |

TABLE 4

| | Component (mol %) | | | | | | | |
|---|---|---|---|---|---|---|---|---|
| | Acicular iron powder | | Inner coating | Diffused layer | | | | Outer layer |
| | Fe | Co | X | Sm | Co | B | $N_2$ | X |
| Example 25 | 87.7 | — | 2.1 | 0.7 | 2.6 | 4.8 | — | 2,1 |
| Example 26 | 78.8 | 8.8 | 2.1 | 0.7 | 2.6 | 4.8 | — | 2.1 |
| Example 27 | 72.2 | 8,0 | 1.9 | 0.6 | 2.4 | 4.4 | 8.5 | 1.9 |

TABLE 5

| | iHc (KOe) | Br (KG) | $(BH)_{max}$(MGOe) |
|---|---|---|---|
| Example 25 | 9.5 | 12.1 | 35.1 |
| Example 26 | 9.5 | 15.1 | 53.5 |
| Example 27 | 9.5 | 23.9 | 113.0 |

[Effect of the invention]

Rare earth element.iron-permanent magnet, rare earth element.iron.boron-permanent magnet and rare earth element.iron.boron.nitrogen-permanent magnet having superior magnetic characteristics, easy production methods thereof and materials therefor are resulted from the invention.

I claim:

1. A process for producing a material for a permanent magnet, wherein the material comprises an acicular iron powder having successively on the surface thereof (1) a coated layer of aluminum phosphate, (2) a diffused layer of rare earth element or a diffused layer of rare earth element-.boron, and (3) a coated layer of aluminum phosphate, wherein the process comprises the steps of:

(a) mixing and covering an acicular goethite (FeOOH) crystal with aluminum phosphate, (b) preparing an acicular iron powder coated with a layer of aluminum phosphate by reducing under hydrogen atmosphere at 300°–500° C. the acicular goethite (FeOOH) crystal covered by aluminum phosphate, (c) diffusing a rare earth element or a rare earth element and boron into the surface layer of aluminum phosphate by heating under argon atmosphere at 650°–1000° C. the acicular iron powder coated with the layer of aluminum phosphate in the presence of the rare earth element or the rare earth element and boron, (d) mixing and covering the rare earth element diffused powder or rare earth element and boron diffused powder with aluminum phosphate, and (e) coating the rare earth element diffused powder or rare earth element and boron diffused powder with aluminum phosphate by heating under argon atmosphere at 300°–500° C. the rare earth element diffused powder or rare earth element and boron diffused powder covered by aluminum phosphate.

2. A process for producing a material for a permanent magnet according to claim 1, wherein the step of diffusing the rare earth element or the rare earth element and boron into the surface layer of aluminum phosphate further comprises heating the acicular iron powder coated with a layer of aluminum phosphate in contact with a vapor comprising the rare earth element or rare earth element and boron.

3. A process for producing a material for permanent magnet according to claim 1, wherein the ratios of components are 1–12 mol% for aluminum phosphate molecule, 0.5–20 mol% for rare earth element atom, 0–12 mol% for boron atom, and the rest for iron.

4. A process for producing a material for permanent magnet according to claim 3, wherein the ratios of components are 1–10 mol% for aluminum phosphate molecule, 0.5–7 mol% for rare earth element atom, 0–12 mol% for boron atom, and the rest for iron.

5. A process for producing a material for permanent magnet according to claim 1, wherein the acicular goethite (FeOOH) crystal is mixed with cobalt powder or cobalt.iron before the step of preparing the acicular iron powder coated with a layer of aluminum phosphate.

6. A process for producing a material for a permanent magnet, wherein the material comprises an acicular iron powder having successively on the surface thereof (1) a coated layer of aluminum phosphate, (2) a diffused layer of rare earth element-nitrogen or a diffused layer of rare earth element-boron-nitrogen, and (3) a coated layer of aluminum phosphate, wherein the process comprises the steps of:

(a) mixing and covering an acicular goethite (FeOOH) crystal with aluminum phosphate, (b) preparing an acicular iron powder coated with a layer of aluminum phosphate by reducing under hydrogen atmosphere 25 at 300°–500° C. the acicular goethite (FeOOH) crystal covered by aluminum phosphate, (c) diffusing a rare earth element or a rare earth element and boron into the surface layer of aluminum phosphate by heating under argon atmosphere at 650°–1000° C. the acicular iron powder coated with a layer of aluminum phosphate in the presence of the rare earth element or the rare earth element and boron, (d) diffusing nitrogen into the rare earth element diffused or the rare earth element and boron diffused surface layer by heating under nitrogen atmosphere at 500°–300° C. the rare earth element diffused or the rare earth element and boron diffused powder, and (e) mixing and covering the rare earth element and nitrogen diffused powder or rare earth element, boron and nitrogen diffused powder with aluminum phosphate, and (f) coating the rare earth element and nitrogen diffused powder or rare earth element, boron and nitrogen diffused powder with aluminum phosphate by heating under argon atmosphere at 300 500° C. the rare earth element diffused powder or rare earth element, boron and nitrogen diffused powder covered by aluminum phosphate.

7. A process for producing a material for a permanent magnet according to claim 6, wherein the step of diffusing the rare earth element or the rare earth element and boron into the surface layer of aluminum phosphate further comprises heating the acicular iron powder coated with a layer of aluminum phosphate in contact with a vapor comprising the rare earth element or rare earth element and boron.

8. A process for producing a material for permanent magnet according to claim 6, wherein the ratios of component are 1–12 mol% for aluminum phosphate molecule, 0.5–20 mol% for rare earth element atom, 0–12 mol% for boron atom, 0.1–10 mol% for nitrogen molecule, and the rest for iron.

9. A process for producing a material for permanent magnet according to claim 8, wherein the ratios of components are 1–10 mol% for aluminum phosphate molecule, 0.5–7 mol% for rare earth element atom, 0–12 mol% for boron atom, 0.1–10 mol% for nitrogen molecule, and the rest for iron.

10. A process for producing a material for permanent magnet according to claim 6, wherein the acicular goethite (FeOOH) crystal is mixed with cobalt powder or cobalt.iron powder before the step of preparing the acicular iron powder coated with a layer of aluminum phosphate.

* * * * *